US009343254B2

(12) United States Patent
Lee

(10) Patent No.: US 9,343,254 B2
(45) Date of Patent: May 17, 2016

(54) BATTERY RELAY FOR AUTOMOBILE

(71) Applicant: Hyundai Motor Company, Seoul (KR)

(72) Inventor: Geon Jong Lee, Jeonju (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/568,873

(22) Filed: Dec. 12, 2014

(65) Prior Publication Data

US 2015/0303014 A1 Oct. 22, 2015

(30) Foreign Application Priority Data

Apr. 18, 2014 (KR) ..... 10-2014-0046389

(51) Int. Cl.

| | |
|---|---|
| ***H01H 9/00*** | (2006.01) |
| ***H01H 50/54*** | (2006.01) |
| ***H01H 50/20*** | (2006.01) |
| ***H01H 50/82*** | (2006.01) |
| *H01H 50/44* | (2006.01) |

(52) U.S. Cl.

CPC ..... *H01H 50/54* (2013.01); *H01H 50/20* (2013.01); *H01H 50/82* (2013.01); *H01H 2050/446* (2013.01)

(58) Field of Classification Search

CPC ..... H01H 13/26; H01H 1/06; H01H 50/54; H01H 50/16; H01H 50/14; H01H 50/02; H01H 50/20; H01H 51/06; F02N 11/00; F02N 15/06

USPC ..... 335/203

See application file for complete search history.

(56) References Cited

U.S. PATENT DOCUMENTS

| | | | | |
|---|---|---|---|---|
| 2,861,550 | A * | 11/1958 | Hanna | F15B 13/0438 137/596.15 |
| 4,379,442 | A * | 4/1983 | Simko | F02M 59/366 123/458 |
| 5,546,061 | A * | 8/1996 | Okabayashi | H01H 9/443 335/126 |
| 5,892,194 | A * | 4/1999 | Uotome | H01H 1/34 218/68 |
| 6,911,884 | B2 * | 6/2005 | Uotome | H01H 47/06 335/132 |
| 7,859,373 | B2 * | 12/2010 | Yamamoto | H01H 50/305 335/126 |
| 7,876,183 | B2 * | 1/2011 | Uruma | H01H 50/04 335/126 |
| 7,978,035 | B2 * | 7/2011 | Usami | H01F 3/02 29/596 |

(Continued)

FOREIGN PATENT DOCUMENTS

| | | |
|---|---|---|
| JP | 05-083993 | 4/1993 |
| JP | 06-200856 | 7/1994 |

(Continued)

*Primary Examiner* — Shawki S Ismail
*Assistant Examiner* — Lisa Homza
(74) *Attorney, Agent, or Firm* — Mintz Levin Cohn Ferris Glovsky and Popeo, P.C.; Peter F. Corless

(57) ABSTRACT

Disclosed is a battery relay for a vehicle. The battery relay has a strengthened operation structure, which includes divided upper plunger and lower plunger by dualizing an internal plunger and induces shocks of the upper plunger and the lower plunger upon initial movement of the lower plunger thereby minimizing the amount of arc generated upon contact and improving durability by shortening a switching time between a movable contact and a fixed contact.

5 Claims, 4 Drawing Sheets

(56) References Cited

U.S. PATENT DOCUMENTS 8,138,863 B2 * 3/2012 Tanaka ..... H01H 1/54 335/126
8,138,872 B2 * 3/2012 Yoshihara ..... H01F 7/1615 335/124
8,179,217 B2 * 5/2012 Kawaguchi ..... H01F 7/1615 335/124
8,198,964 B2 * 6/2012 Yoshihara ..... H01H 51/29 335/131
8,269,585 B2 * 9/2012 Choi ..... H01H 1/2008 335/126
8,274,347 B2 * 9/2012 Eum ..... H01H 9/341 335/156
8,395,463 B2 * 3/2013 Ito ..... H01H 9/34 335/202
8,549,734 B2 * 10/2013 Yeon ..... H01H 49/00 218/118
9,070,525 B2 * 6/2015 Hirabayashi ..... H01H 50/54
9,082,576 B2 * 7/2015 Nishimura ..... H01H 50/643
2006/0050466 A1 * 3/2006 Enomoto ..... H01H 50/02 361/160
2010/0033276 A1 * 2/2010 Niimi ..... H01H 50/30 335/202
2013/0088312 A1 * 4/2013 Isonaga ..... H01H 50/20 335/192
2013/0093542 A1 * 4/2013 Sora ..... H01F 7/1607 335/192

FOREIGN PATENT DOCUMENTS

| | | | |
|---|---|---|---|
| JP | 07-235248 | A | 9/1995 |
| JP | 2002-208338 | A | 7/2002 |
| JP | 2007-109470 | | 4/2007 |
| JP | 2007-109470 | A | 4/2007 |
| JP | 2011-009063 | | 1/2011 |
| KR | 10-0461126 | | 12/2004 |
| KR | 10-2007-0016552 | | 2/2007 |

* cited by examiner (a)

(b)

BATTERY RELAY FOR AUTOMOBILE

CROSS-REFERENCE TO RELATED APPLICATION

This application claims under 35 U.S.C. §119(a) the benefit of Korean Patent Application No. 10-2014-0046389 filed on Apr. 18, 2014, the entire contents of which are incorporated herein by reference.

TECHNICAL FIELD

The present invention relates to a battery relay for a vehicle. The battery relay for the vehicle may minimize an amount of arc generated upon a contact by reducing a switching on/off time between a movable contact and a fixed contact thereby improving durability.

BACKGROUND

In general, battery relays control battery power supplied to a load side of a vehicle and are primarily applied to medium/large-sized buses. When the battery relays receive power from a power source such as a battery, a bobbin unit therein may generate magnetic force and a movable contact installed in a plunger may contact a fixed contact as an internal plunger is moved by the magnetic force, and as a result, the battery power may be supplied to a load terminal.

For example, FIG. 1 shows a cross-sectional view illustrating a battery relay for a vehicle in the related art.

As illustrated in FIG. 1, the battery relay in the related art is constituted by a movable unit 10 including a plunger 11 and a movable contact 12 integrated, a return spring 21 elastically supporting the movable unit 10 at a lower side of the plunger, a fixed unit 20 supporting a lower part of the return spring 21 and accommodating the movable unit 10, a fixed contact 22 fixedly disposed at a lower side of the movable contact 12, and a bobbin unit 23 disposed on a lower outer peripheral surface of the plunger 11 and selectively connected to a power supply by start on/off of the vehicle.

In the battery relay in the related art, when current flows on the bobbin unit 23 and the movable unit 10 is thus magnetized, the movable unit 10 which is distant from the fixed unit 20 by the return spring 21 may overcome spring force from the return spring 21 by the magnetic force. As such, the movable contact 12 and the fixed contact 22 may contact. In addition, when the fixed unit 20 and the movable unit 10 contact each other, the spring force of an assistant spring 13 installed on the top of the movable contact 12 may be additionally applied. Accordingly, the movable contact 12 and the fixed contact 22 may contact each other with improved force. Upon returning, the movable unit 10 may be moved by the spring force of the return spring 21, and the contact may be released.

Since the battery relays for the vehicles applied to the medium/large sized buses generally may use substantial amount of current, arc generated when the movable contact and the fixed contact contact each other may not be fully removed.

In conventional battery relay, since the movable unit 10 moves by overcoming the spring force with only the magnetic force of the bobbin unit 23 when the battery relay is turned on, the movable unit 10 may be moved by less force than the magnetic force and the movable unit 10 may be moved with reduced magnetic force upon switching (contacting). A movement speed of the movable unit 10 may be low and a switching time may increase when a contact formed between the movable contact 12 and the fixed contact 22. Accordingly, a large amount of arc may be continuously generated at a contact portion between the movable contact 12 and the fixed contact 22. Consequently, fusion of the contact portion may be accelerated.

Moreover, in the battery relay in the related art, the movable unit 10 may return by only the spring force when the battery relay is turned off and a movement time of the movable unit 10 may increase upon returning. Therefore, the contact portion between the movable contact 12 and the fixed contact 22 may receive greater amount of arc and a fusion time of the contact portion may be reduced in accordance with an increase in the amount of generated arc.

Accordingly, there is a demand for an operation structure which may minimize the amount of arc generated upon contact and improve durability of the relay by shortening the switching time between the movable contact and the fixed contact.

The above information disclosed in this Background section is only for enhancement of understanding of the background of the disclosure and therefore it may contain information that does not form the prior art that is already known in this country to a person of ordinary skill in the art.

SUMMARY OF THE INVENTION

In one aspect, the present invention provides a battery relay for a vehicle with a strengthened operation structure. In particular, the operation structure may include divided upper plunger and lower plunger by dualizing an internal plunger and induce shocks of the upper plunger and the lower plunger upon initial movement of the lower plunger to minimize the amount of arc generated upon contact, thereby improving durability by shortening a switching time between a movable contact and a fixed contact.

In an exemplary embodiment, the present invention provides a battery relay for a vehicle which may include: a movable unit configured by integrated coupling of a plunger and a movable contact; and a fixed unit with a fixed contact that may be fixedly disposed at a lower side of the movable contact. In particular, the plunger may be constituted by an upper plunger at an upper side thereof and a lower plunger at a lower side coupled with an intermovable space through a fastening pin such that the lower plunger may move prior to the upper plunger when the plunger moves up and down. As such, a switching speed between the movable contact and the fixed contact may increase due to a collision between the upper plunger and the lower plunger.

In addition, the lower plunger may have a groove having an upper end into which a lower end of the upper plunger may be inserted and a lower pin hole assembled with the fastening pin through the groove. The upper plunger may have an upper pin hole formed on the lower end inserted into the groove. In particular, the lower pin hole may be formed by a regular hole and the upper pin hole may be formed by a long hole.

Moreover, the movable contact may be integrally coupled with the upper plunger at an upper side of the upper pin hole formed on the lower end of the upper plunger.

The battery relay may further include: a returning spring elastically supporting the movable unit at a lower side of the lower plunger; and a bobbin unit fixedly disposed on an outer peripheral surface of the lower plunger and selectively magnetizing the movable unit by start on/off of a vehicle.

According to various exemplary embodiments of the present invention, a battery relay may reduce a switching on/off time between a movable contact and a fixed contact and thus reduce and minimize the amount of arc generated upon switching, thereby improving fusion of a contact portion and improving durability.

Other aspects and preferred embodiments of the disclosure are discussed infra.

BRIEF DESCRIPTION OF THE DRAWINGS

The above and other features of the present invention will now be described in detail with reference to various exemplary embodiments thereof illustrated in the accompanying drawings which are given hereinbelow by way of illustration only, and thus are not limitative of the present disclosure, and wherein.

Figure 1:
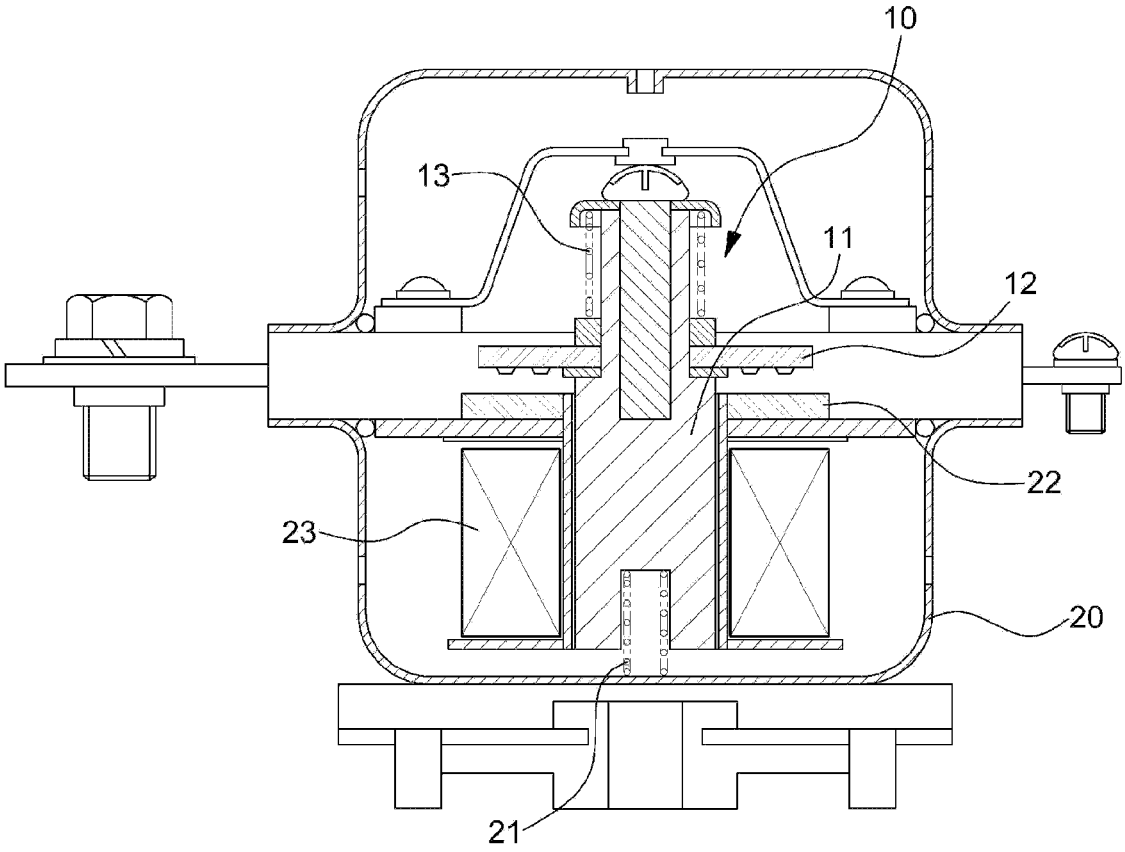
PRIOR ART FIG.1
FIG. 1 illustrates a conventional battery relay for a vehicle in the related art.

Reference numerals set forth in the Drawings includes reference to the following elements as further discussed below:

100: Movable unit
110: Plunger
111: Upper plunger
111*a*: Upper pin hole
112: Lower plunger
112*a*: Lower pin hole
112*b*: Groove
120: Movable contact
140: Assistant spring
200: Fixed unit
210: Return spring
220: Fixed contact
230: Bobbin unit
240: Stopper It should be understood that the appended drawings are not necessarily to scale, presenting a somewhat simplified representation of various exemplary features illustrative of the basic principles of the disclosure. The specific design features of the present disclosure as disclosed herein, including, for example, specific dimensions, orientations, locations, and shapes will be determined in part by the particular intended application and use environment.

In the figures, reference numbers refer to the same or equivalent parts of the present disclosure throughout the several figures of the drawing.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Hereinafter, reference will now be made in detail to various exemplary embodiments of the present invention, examples of which are illustrated in the accompanying drawings and described below.

The present invention relates to a battery relay which controls battery power supplied to a load side of a vehicle. The battery relay may dualize an internal plunger and separate the internal plunger into an upper part and a lower part and thus, a switching time or contact time between a movable contact and a fixed contact may be reduced by using impact force generated when both upper and lower plungers collide with each other upon turn on/off of the battery relay thereby minimizing an amount of arc generated upon contact and improving durability.

Figure 2:
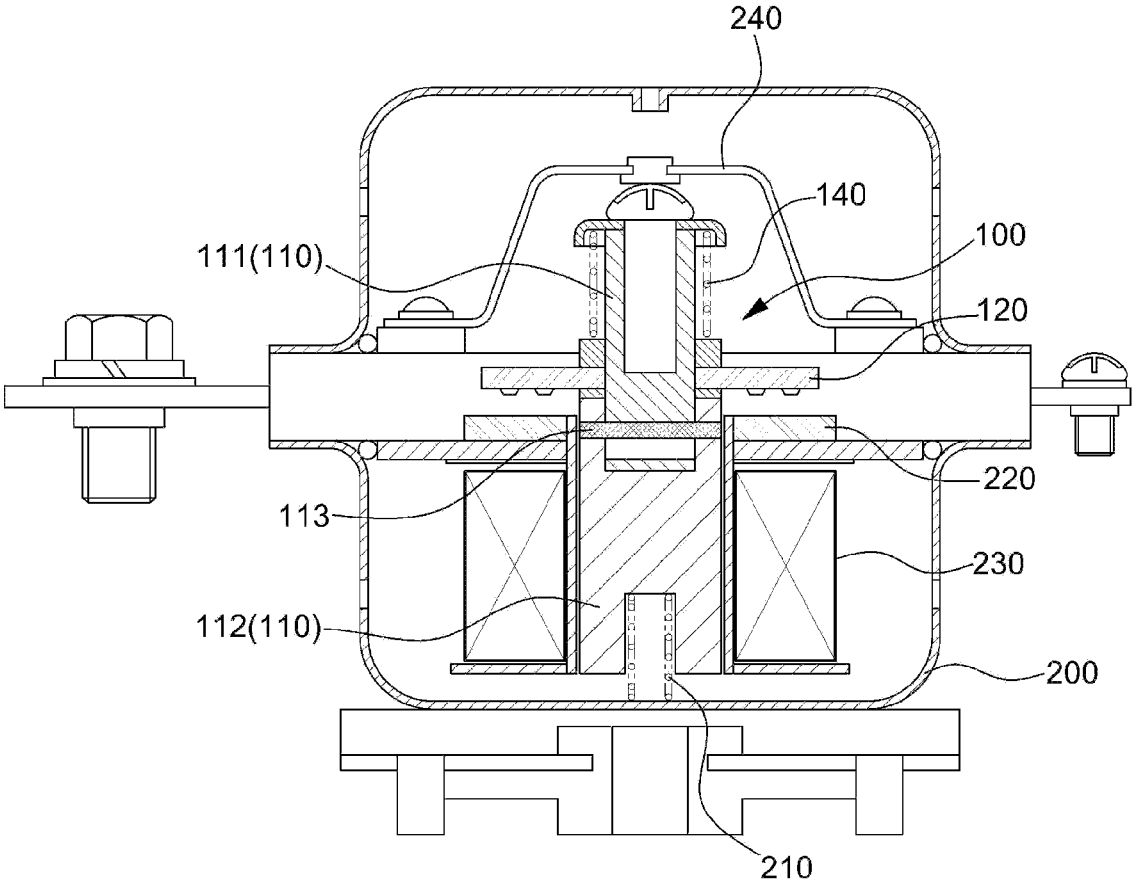
FIG. 2 illustrates an exemplary battery relay for a vehicle according to an exemplary embodiment of the present invention.

As illustrated in FIG. 2, the battery relay according to an exemplary embodiment of the present invention may include: a movable unit 100 configured by integrated coupling of a plunger 100 and a movable contact 120; a return spring 210 elastically supporting the movable unit 100 at a lower side of the plunger or a lower plunger 110; a fixed unit 200 supporting the bottom of the return spring 210 and accommodating the movable unit 100 and a bobbin unit 230; a fixed contact 220 fixedly disposed at a lower side of the movable contact 120 in the fixed unit 200; and the bobbin unit 230 fixedly disposed on a lower outer peripheral surface or an outer peripheral surface of the lower plunger of the plunger 110 to surround the outer peripheral surface and selectively connected to a batter power supply by start-on/off of a vehicle.

As disclosed herein, the bobbin unit 230 may include an excitation coil. When the battery power is supplied to the bobbin unit 230 and current flows on the bobbin unit 230, a magnetic field may be formed around the bobbin unit 230 to magnetize the movable unit 100.

Further, the battery relay may include an assistant spring 140 assisting contacting operations of the movable contact 120 and the fixed contact 220 upon switching-on and a stopper 240 stopping the returned movable unit 100 at a predetermined height upon switching-off.

Figure 3:
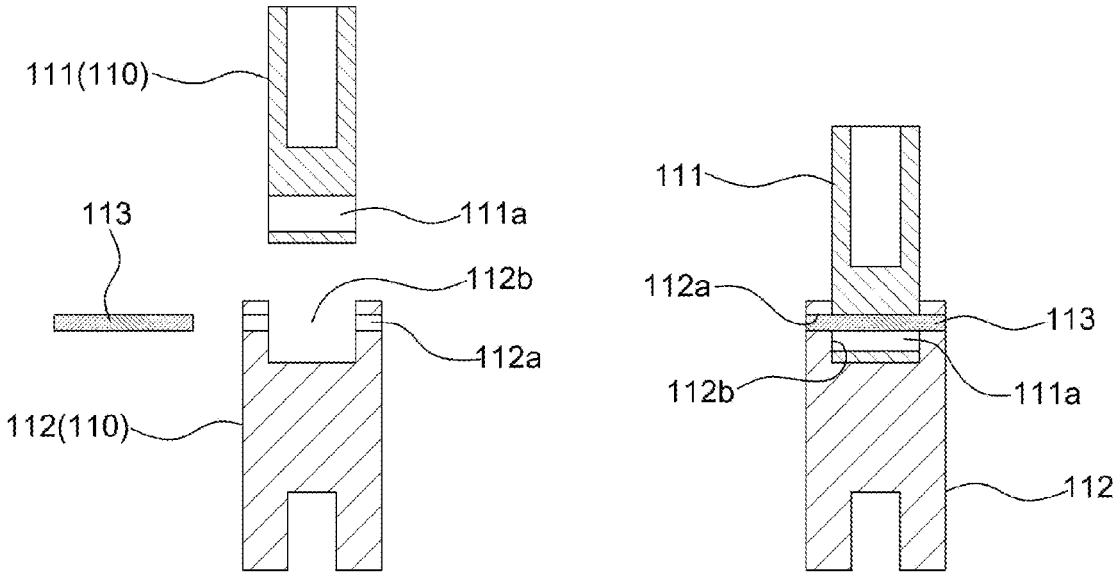
FIG. 3 illustrates a front view and a side view of an exemplary assembly structure of an exemplary plunger for an exemplary battery relay according to an embodiment of the present invention.
Figure 3:
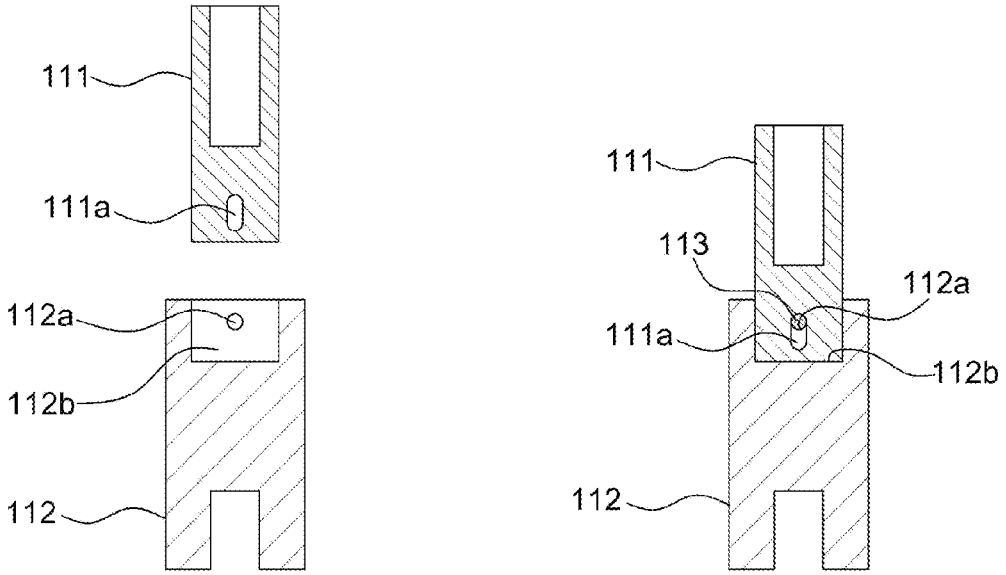

As illustrated in FIG. 3, the plunger 110 may include an upper plunger 111 and a lower plunger 112 coupled with an intermovable space to each other through a fastening pin 113.

When the upper plunger 111 and the lower plunger 112 are coupled with each other and the movable contact 120 is integrally coupled at an upper side of an upper pin hole 111*a*, the upper plunger 111 may have a smaller diameter than the lower plunger 112 and the upper pin hole 111*a* into which the fastening pin 113 is penetratively inserted may be formed at a lower end portion which is inserted into the lower plunger 112. In particular, the upper pin hole 111*a* may be formed as a long hole which may elongate in one direction and the long hole may be movable up and down while the fastening pin 113 is inserted into the upper pin hole 111*a*.

The lower plunger 112 may have a greater diameter than the upper plunger 111 and a lower pin hole 112*a* for assembling a groove 112*b* where a lower end of the upper plunger 111 may be inserted, and the fastening pin 113 may be formed on an upper end of the lower plunger.

The groove 112*b* may be provided at a predetermined depth at which a lower end of the upper plunger 111 may be inserted into the upper pin hole 111*a* and the lower pin hole 112*a* may be formed on a straight line that penetrates the groove 112*b*. In particular, the lower pin hole 112*a* may be formed as a regular hole having a circular shape with the center to which the fastening pin 113 may be fixed while being penetratively inserted into the groove 112*b*.

As illustrated in FIG. 3, the plunger 110 may be configured in such a manner that the lower end of the upper plunger 111 may be inserted into the groove 112*b* of the lower plunger 112 and thereafter, the fastening pin 113 may be inserted into both the upper pin hole 111*a* and the lower pin hole 112*a*. As such, the upper plunger 111 and the lower plunger 112 may be coupled with each other.

In addition, the fastening pin 113 may move integrally with the lower plunger 112 that moves up and down and moves integrally with the upper plunger 111 in response to a longitudinal length of the upper pin hole 111*a* after the lower plunger 112 moves by a predetermined interval.

In particular, the plunger 110 may be divided into two parts of an upper plunger 111 and a lower plunger 112 and the upper plunger 111 and the lower plunger 112 may be coupled with each other by the fastening pin 113. The upper pin hole 111*a* of the upper plunger 111 may be formed by the long hole and the upper plunger 111 and the lower plunger 112 may be coupled with each other to be capable of moving vertically. Therefore, when the lower plunger 112 moves up and down, the lower plunger 112 may initially move in an initial predetermined interval and a collision (in detail, a collision with the fastening pin 113) between the upper plunger 111 and the lower plunger 112 may occur just before the upper plunger 111 and the lower plunger 112 integrally move (FIGS. 4 and 5).

A movement speed of the movable contact 120 integrally coupled to the upper plunger 111 may increase by impact force generated by the collision and a movement time may be reduced. As such, a switching time of the battery relay may be reduce thereby to minimizing the amount of arc generated upon switching, and fusion of a contact portion may be prevented.

Hereinafter, an exemplary operation state of the battery relay using the plunger 110 will be described with reference to FIGS. 4 and 5.

Figure 4:
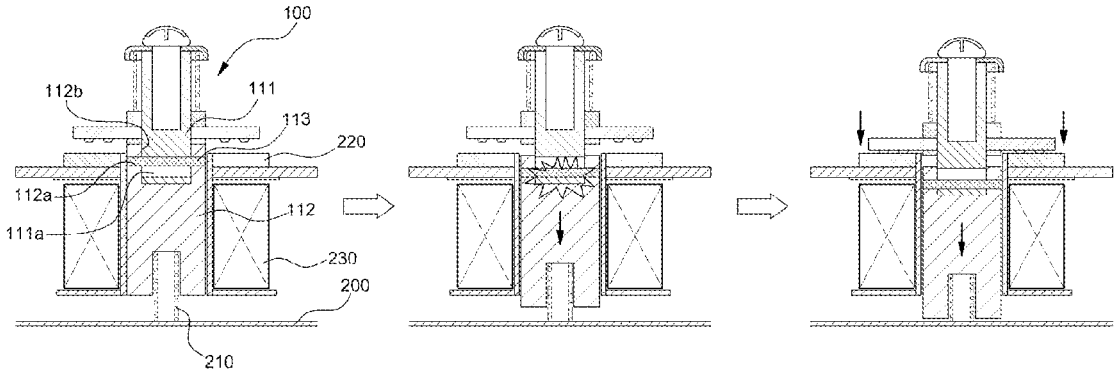
FIG. 4 illustrates an exemplary operation state of an exemplary battery relay for a vehicle upon start-on according to an embodiment of the present invention.
Figure 5:
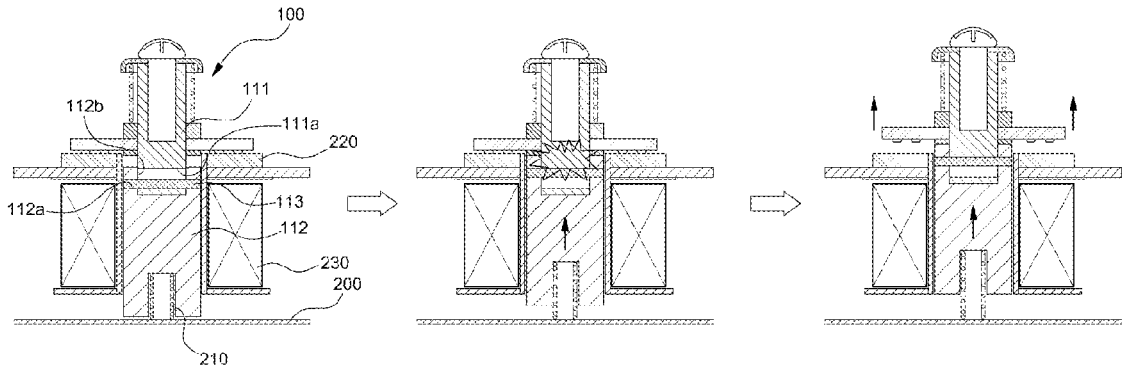
FIG. 5 illustrates an exemplary operation state of an exemplary battery relay for a vehicle upon start-off according to an embodiment of the present invention.

As illustrated in FIG. 4, in an exemplary battery relay of the invention, when the vehicle is started in an initial state of FIG. 4, current flows on the bobbin unit 230 and the movable unit 100 including the plunger 110 may be subsequently magnetized and the plunger 110 separated from the fixed unit 200 by the return spring 210 may overcome the spring force of the return spring 210 by the magnetic force and may move down.

In particular, only the lower plunger 112 may move down by a predetermined distance or by about the longitudinal length of the upper pin hole 111*a* during initial movement, and as consequence, the lower plunger 112 may collide with the upper plunger 111 to impact the upper plunger 111.

Accordingly, as the movable unit 100 moves by the magnetic force of the movable unit 100 and impact force by the collision, the movable contact 120 may move down at substantial speed and may contact the fixed contact 220 to be switched on, and as a result, a switching-on speed may be improved and the amount of generated arc may be reduced.

The assistant spring 140 may be instantly compressed and thereafter, restored by retroaction generated while the fixed contact 220 and the movable contact 120 contact each other upon switching-on (contacting) to press the movable contact 120. Accordingly, the movable contact 120 and the fixed contact 220 may contact each other with greater force by receiving the spring force of the assistant spring 140 upon contact.

The battery relay may remain the switching-on state while the vehicle is driven and the supply of the current to the bobbin unit 230 is stopped, and the magnetic force of the movable unit 100 may be removed when the start of the vehicle is turned off. As such, the plunger 110 may be returned up by elastic restoration force of the return spring 210.

As illustrated in FIG. 5, only the lower plunger 112 may move up by a predetermined distance during initial movement, and thus, the lower plunger 112 may collide with the upper plunger 111 to impact the upper plunger 111.

Accordingly, the plunger 110 and the movable contact 120 may be restored up by the elastic restoration force of the return spring 210 and impact force generated upon the collision, such that the movable contact 120 may be rapidly separated from the fixed contact 220 to improve a switching-off speed and reduce generation of arc.

Moreover, as the plunger 110 is dualized, a weight may decrease compared with the conventional integrated plunger, and thus, the plunger 110 may move at a relatively greater speed by the same force to enhance a switching speed.

Meanwhile, when the magnetic force disappears before the returning of the movable unit 100 and only the spring force of elastic restoration force remains, the lower plunger 112 may move by the spring force. In other words, elastic energy of the return spring 210 may be converted into motion energy of the lower plunger 112 and subsequently a motion amount of the lower plunger 112 generated by the motion may be converted into an impact amount at the moment when the lower plunger 112 collides with the upper plunger 111. In addition, since a collision time between both plungers 111 and 112 may be substantially short, strong impact force may be finally applied to move the movable unit 100.

As disclosed herein, the spring force F' may be represented by the equation, $F'=kx=ma$ and the elastic energy W' of the return spring 210 may be represented by the equation $W'=\frac{1}{2}kx^2$, the motion energy W of the lower plunger 112 may be represented by the equation $W=\frac{1}{2}mv^2$, and the impact amount may be equal to the motion variation amount as described in the equation below when the impact is applied:

$$\text{the impact amount}=\text{the motion variation amount}=(v-v')m=\text{the impact force }(F)*a*\text{time }(t)$$

Herein, k refers to a spring elastic coefficient, x refers to a spring transformation distance, m refers to a weight of the lower plunger, a refers to a movement acceleration of the lower plunger, v refers to a movement speed of the lower plunger before the collision, and v' refers to the movement speed of the lower plunger after the collision.

Since the elastic energy W' of the return spring 210 is converted into the motion energy W of the lower plunger 112 according to the equation of $kx^2=mv^2$ and the movement speed of the lower plunger 112 becomes 0 at the moment when the lower plunger 112 and the upper plunger 111 collide with each other, the impact force F may be $$F = \frac{\sqrt{km} * x}{t}.$$

In this case, m may be equal to k and when t is 1 s, the impact force F and the spring force F' may be equal to each other.

Since the upper plunger 111 and the lower plunger 112 collide with each other for a very short time, t may be reduced substantially.

Accordingly, when t is approximately 1 ms, the impact force F' which is about 1000 times stronger than the spring force F' may be generated and the movement acceleration of the plunger 110 may also be instantly about 1000 times greater than the movement acceleration of the conventional plunger upon the collision.

Accordingly, since substantially greater force is instantly applied to the movable unit 100 upon the switching-off and the movable contact 120 thus moves rapidly, the arc generated at the contact portion when the movable unit 100 is returned may be minimized, thereby preventing the contact portion from being fused.

The disclosure has been described in detail with reference to exemplary embodiments thereof. However, it will be appreciated by those skilled in the art that changes may be made in these embodiments without departing from the principles and spirit of the disclosure, the scope of which is defined in the appended claims and their equivalents.

What is claimed is:

1. A battery relay for a vehicle comprising:

a movable unit configured by integrated coupling of a plunger and a movable contact; and a fixed unit with a fixed contact that is fixedly disposed at a lower side of the movable contact, wherein the plunger is constituted by an upper plunger at an upper side thereof and a lower plunger at a lower side coupled with an intermovable space through a fastening pin, such that as the lower plunger moves prior to the upper plunger when the plunger moves up and down, a switching speed between the movable contact and the fixed contact increase due to a collision between the upper plunger and the lower plunger.

2. The battery relay of claim 1, wherein the lower plunger has a groove having an upper end into which a lower end of the upper plunger is inserted and a lower pin hole assembled with the fastening pin through the groove and the upper plunger has an upper pin hole formed on the lower end inserted into the groove, and the lower pin hole is formed as circular hole and the upper pin hole is formed as a elongated hole.

3. The battery relay of claim 1, wherein the movable contact is integrally coupled with the upper plunger at an upper side of the upper pin hole formed on the lower end of the upper plunger.

4. The battery relay of claim 1, further comprising:

a returning spring elastically supporting the movable unit at a lower side of the lower plunger; and a bobbin unit fixedly disposed on an outer peripheral surface of the lower plunger and selectively magnetizing the movable unit by start on/off of a vehicle.

5. A vehicle comprising the battery relay of claim 1.

* * * * *